United States Patent [19]

Gilmore

[11] 4,229,842

[45] Oct. 28, 1980

[54] SHOWER CURTAIN CONVERTIBLE SUPPORT ADAPTER

[76] Inventor: Louis Gilmore, 245 E. 80th St., Suite 1C, New York, N.Y. 10021

[21] Appl. No.: 31,494

[22] Filed: Apr. 20, 1979

[51] Int. Cl.[3] ..... A47K 3/22

[52] U.S. Cl. ..... 4/610; 4/558

[58] Field of Search ..... 4/145, 146, 153, 154, 4/149

[56] References Cited

U.S. PATENT DOCUMENTS

| | | | |
|---|---|---|---|
| 2,545,648 | 3/1951 | Byrne | 4/149 |
| 2,573,985 | 11/1951 | Porter | 4/149 |
| 2,654,893 | 10/1953 | Scranage | 4/154 |
| 2,774,974 | 12/1956 | Zaloga | 4/154 |
| 3,104,014 | 9/1963 | Piette | 4/154 X |
| 3,418,665 | 12/1968 | Long | 4/149 |
| 3,872,520 | 3/1975 | Tyconik | 4/154 |
| 4,158,896 | 6/1979 | Farkas | 4/145 X |

*Primary Examiner*—Henry K. Artis
*Attorney, Agent, or Firm*—Arthur Dresner

[57] ABSTRACT

A shower curtain adapter for expanding the showering space within a shower enclosure, which enclosure has first and second facing vertical sidewalls, a third wall which extends between the first and second sidewalls and a shower curtain which hangs from a straight standard curtain rod extending between the first and second walls. The adapter of the present invention includes an adapter rod having a length which is greater than the distance between the first and second walls and which is made of flexible material. The adapter rod may be mounted in an operative position between the first and second walls and in such position will flex into a bow configuration to engage the hanging shower curtain pushing it outward of the enclosure to expand the showering space. A coupling means for supporting the adapter rod from the standard curtain rod is pivotally coupled at one end thereof to the adapter rod and has means carried at the other end for coupling to the standard curtain rod to thereby prevent downward movement of the adapter rod when mounted in its operative position. When in its storage position, the adapter rod will hang by the coupling means from the curtain rod and may be concealed behind the shower curtain.

12 Claims, 4 Drawing Figures

SHOWER CURTAIN CONVERTIBLE SUPPORT ADAPTER

BACKGROUND OF THE INVENTION

This invention generally relates to shower-bath structures that have a floor area serving as a water catch and drain basin and more particularly to a support adapter for a shower curtain used with such structures.

Most shower-bath installations are restricted to a relatively narrow bath tub and/or small floor area in order to conserve space. The lower space is usually sufficient for a bathers lower body portion, however, a vertically arranged curtain often restricts normal body movement and comfort from the waist up. It is an object of the present invention to overcome this poor design without having to increase the base area. It is a further object of the invention to provide an adapter device for use in a shower-bath structure which is used only during shower activity to sufficiently increase the area above the waist to within more than comfortable and acceptable range. These objects can be accomplished in existing and/or new installations.

Furthermore, this shower curtain adapter device of the present invention will provide added control support to the outside (right & left) curtain edges so as to prevent billowing caused by water pressure, temperature changes due to the creation of steam and generally draft producing conditions. With the leading edges of a shower curtain brought under positive control, the water activity within shower chamber can be properly diverted into the base drain system, this preventing water leakage outside of the shower area.

This shower curtain adapter device will provide room for sufficient physical mobility, therefore, eliminating the likelihood of the bather coming in contact with the shower curtain and causing it to adhere or cling to his body. The elimination of physical contact with the curtain, which is an annoyance, also guarantees the user a semi-permanent water seal between the shower area and other functional areas of the bathroom.

It is important to note that the use of the adapter device of the present invention expands the space on the shower side of the curtain and protrudes into the non-shower side only during actual shower time and therefore does not permanently take up valuable space during normal bathroom activity.

During non-shower activity periods, this adapter can easily be converted into a storage configuraton without removing it from the horizontal bar, and stowed within the backside of the shower curtain folds without being obvious to guests. Other objects, features and advantages of the present invention will become more apparent to those skilled in the art from the description of the invention in connection with the following accompanying drawings.

BRIEF DESCRIPTION OF THE DRAWINGS

Referring to the accompanying drawings which are for illustrative purposes.

DESCRIPTION OF THE INVENTION

Figure 1:
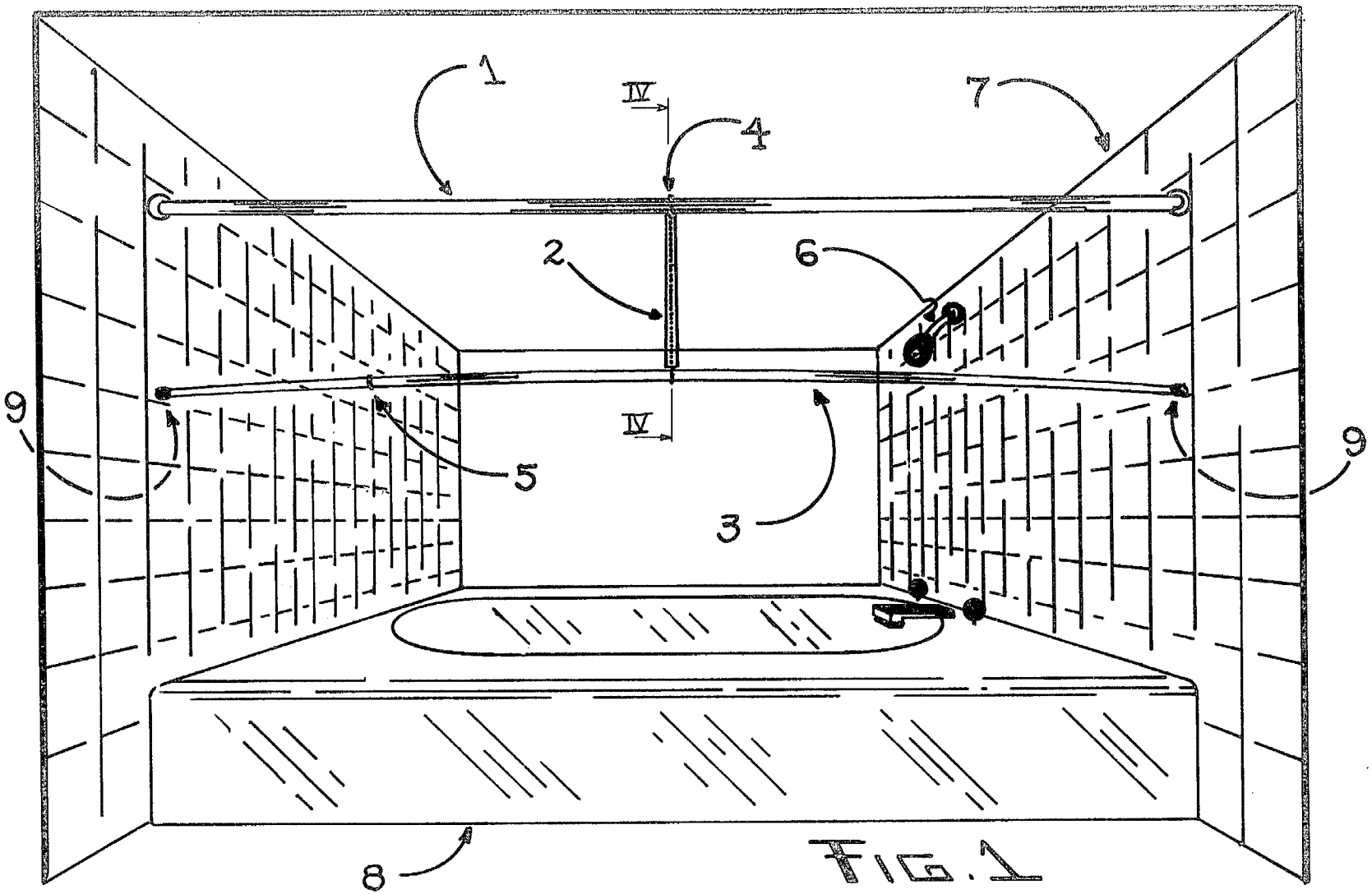
FIG. 1 is a perspective view of a shower installation utilizing a conventional bath tub as its water catch and drain basin and illustrating the present invention.

Referring in more detail to the drawings, FIG. 1 shows a preferred embodiment of the invention in its operative position, as applied to a conventional over the tub shower installation. Tub 8 is set into a cavity area surrounded by walls 7. A standard shower head 6 is shown on the right hand wall 7, and a standard shower curtain rod 1 is mounted by end supports directly above the leading edge of the tub.

A flexible adapter rod 3 is pressure mounted between the right and left hand verticle walls by rubber tips 9 to provide friction causing the adapter rod to bow outward. This rod 3 is vertically supported by a ball chain 4 to prevent downward gravity movement and a hollow vertical tube 2 to prevent upward movement or oblique positioning away from the shower stall. Thus with only one center slideable attachment ball chain 4 and the self exerted pressure points at the rubber tips 9 the rod combination 3, 2 & 4 easily and efficiently supports and maintains a shower curtain in an acceptable and taut position without permanently wasting valuable space. The rod combination is easily converted from its bowed operable position to a storage or non-operable position.

Figure 2:
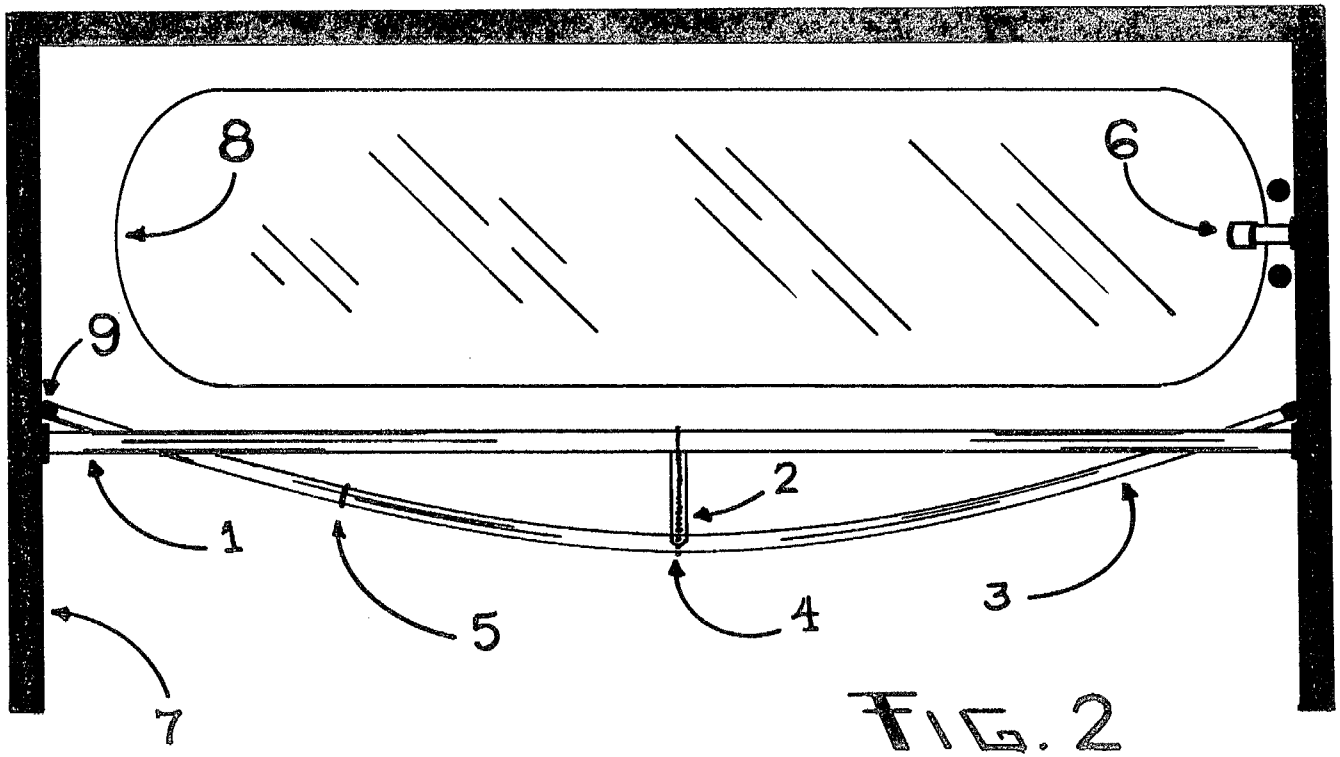
FIG. 2 is a top plan view of FIG. 1 showing the shower curtain adapter of the present invention in its functional (BOW) configuration.

FIG. 2 illustrates top view of the expanded of space made possible by the invention for the critical body movement areas (waist & above), as compared to the conventional restrictive space provided by the standard shower rod 1. This additional space also conveniently provides ample room for the hanging of wet apparel (bathing suits, stockings, etc.) with positive control of water drippage into basin drain areas without being noticably visable to guests.

Figure 3:
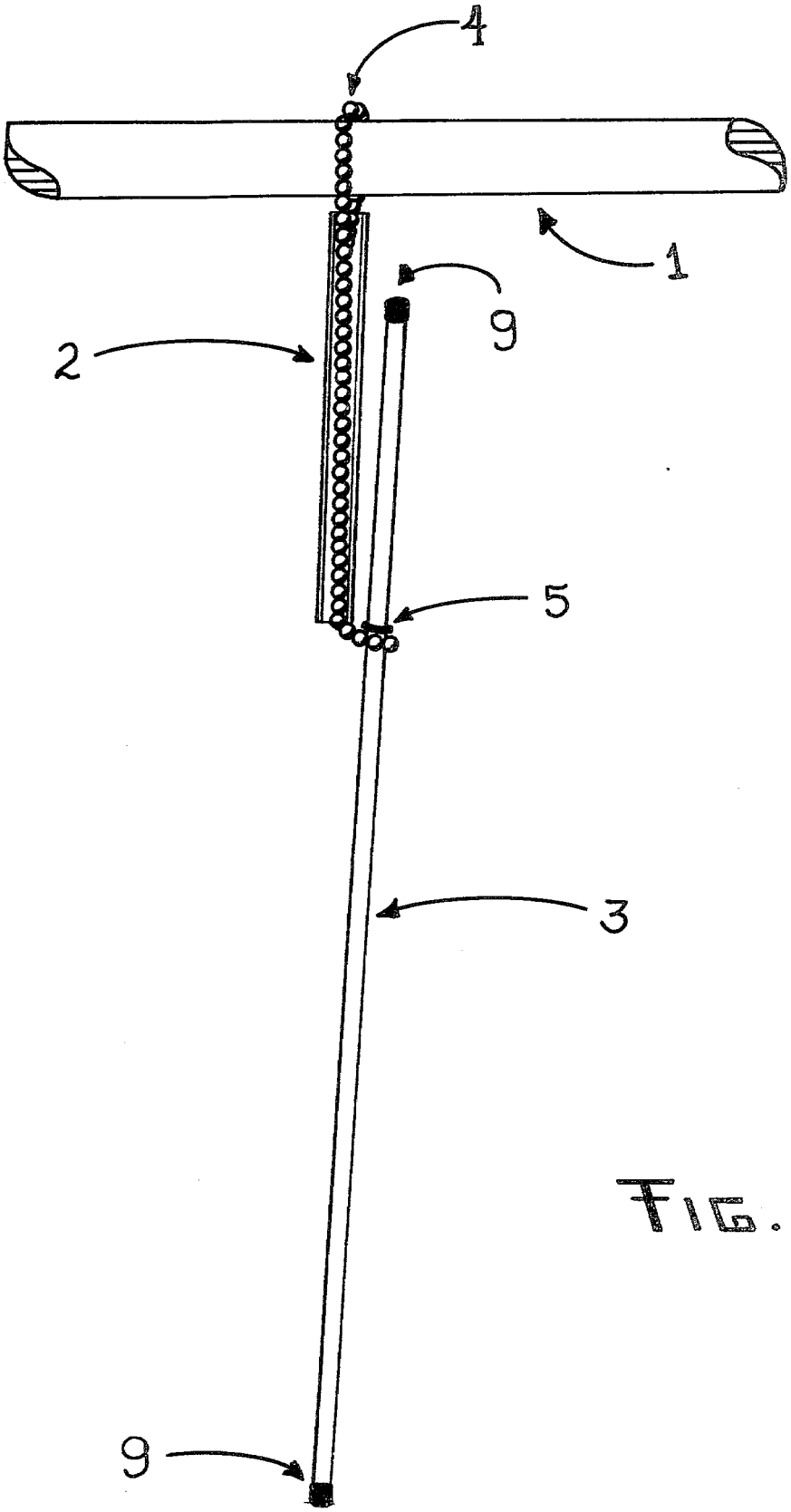
FIG. 3 is a semi-fragmentary view illustrating the storage configuration of the invention without detachment from the horizontal bar.

FIG. 3, partial fragmentation of horizontal bar 1 illustrates the simplicity of attachment of the ball chain 4 around the standard curtain rod through tube 2 and around adapter rod 3.

FIG. 3 also depicts the adapter rod 3 in its converted stow away configuration. This is accomplished by the de-bowing rod 3, with a slight movement from right to left of the rod and with the assistance of gravity will allow rod 3 to slide downward until a doughnut rubber washer 5 meets with the bottom loop of ball chain 4 this restricting further movement of rod 3 and at the same time positioning the entire device in a relatively verticle position to allow for hidden storage on the shower side of the curtain, completely hidden from view.

Figure 4:
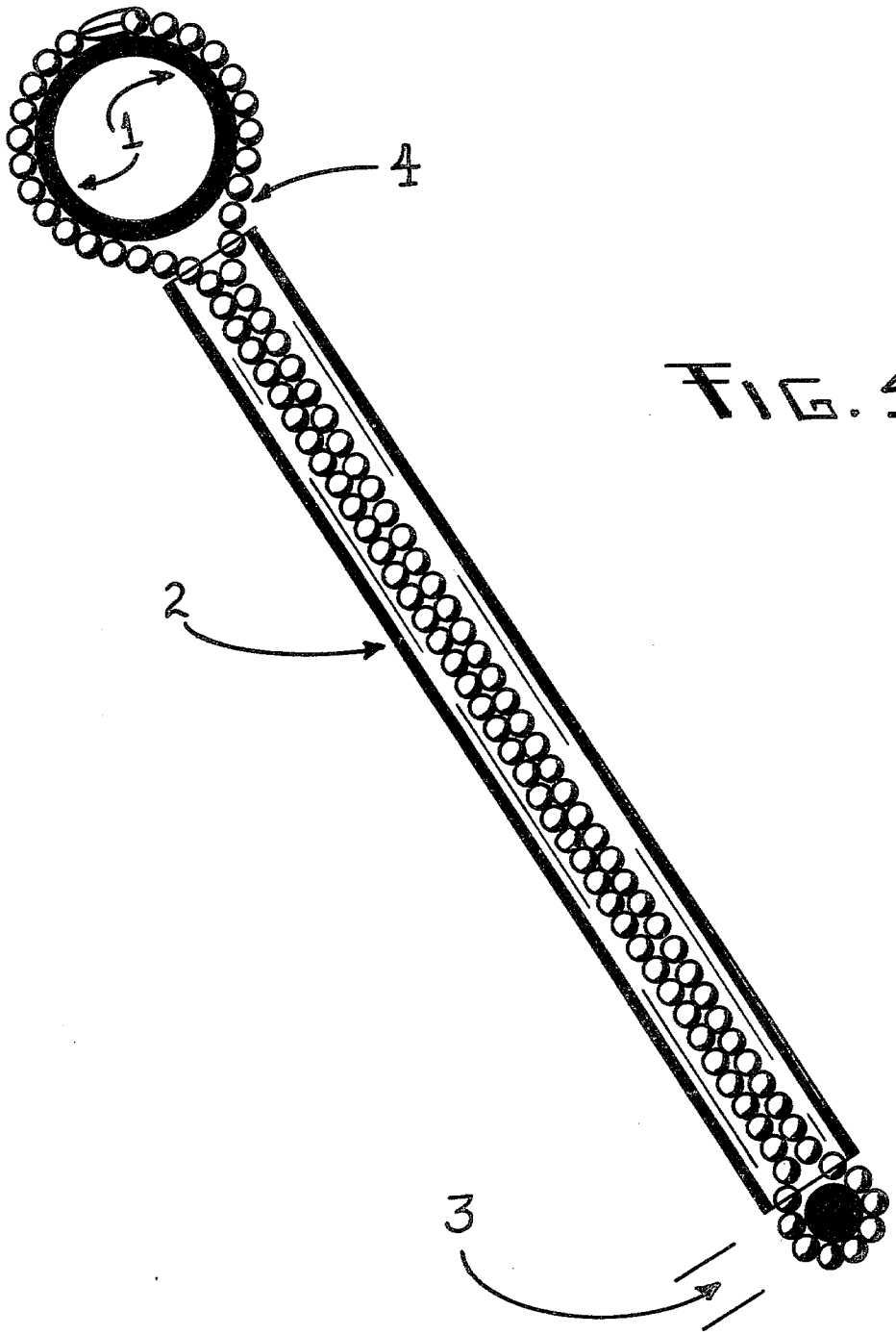
FIG. 4 is an enlarged cross sectional view taken along lines IV—IV of FIG. 1, illustrating the functional control arm and its means of attachment.

FIG. 4 illustrates in cross-section the interrelationship of the various elements of the invention. Ball chain 4 is carried around curtain rod 1 and extends through hollow tube 2 and around adapter rod 3. Ball chain 4 ties all adapter parts together and at the same time allows each to rotate easily in all directions. A complete cycle from storage to the expanded configuration and retrun can thus easily be accomplished. All of the above can be accomplished with slight maneuvering techniques, bowing pressure points, and gravity. Tools are not necessary to complete any of the functions.

All of the above has been accomplished through the unique assemblage of premanufactured and readily available components without the use of complex moving parts. The novel use of simple and relatively inexpensive materials makes this invention available to the majority of private and commercial consumers. The simplicity and use of the various operative parts clearly distinguishs this invention from any previously manufactured adaptation to the standard shower curtain.

Furthermore, it should be apparent to those skilled in the art that the simplcity of the present invention accounts for its uniqueness.

FIGS. 1 and 2 clearly illustrate the simplicity of installation eliminating the need for structural or other major change in the original bath/shower facility.

This simplicity of fabrication and assembly can be more easily understood from FIGS. 3 and 4. The following is a brief outline of the parts necessary to complete the invention for its intended use:

A. ITEM No. 2 . . . Tube-like plastic or metallic frame approximately ⅜" I.D. and ½" O.D. with a length of from ⅓ to ½ the distance of the height of the vertical space between the stationary standard shower curtain rod and the bottom of the tub or drain basin. Plastic can be organic or synthetic-molded, cast, extruded, drawn, or laminated. Materials must be able to withstand temperature change, water and chemical exposure that can be anticipated during extended normal shower use.

B. ITEM No. 3 . . . Can be fabricated from material similar to those suggested in ITEM No. 2, however, it must be resilient and flexible and although it may be tube-like in its basic shape it need not be hollow as long as it meets the above requirements. The diameter should be approximately ⅜" O.D. and its length can vary from 5 to 10% longer than the stationary standard curtain rod, depending on the personal need for more "Bowing" effect and the size and configuration of the shower facility.

C. ITEM No. 4 . . . "BALL-CHAIN" should be at least ⅛" diameter-rust and corrosion resistant and approximately 2¼ times the length of ITEM No. 2. It should be apparent that the ball-chain can be replaced by any structure which is capable of performing the functions of the ball-chain. Alternative structures should have similar flexibility and maneuverability qualities as well as durability and ease of installation as well as removal.

D. ITEM No. 5 . . . Rubber doughnut shaped stop washer should fit tightly over the rod 3 to serve as a holding device to prevent the rod from slipping through the ball-chain 4 while in a storage configuration shown in FIG. 3.

E. ITEM No. 9 . . . Friction tips should be fabricated from rubber-like material to promote a high friction factor to aide in the holding quality when rod 3 is in the bowed pressure holding configuration as shown in FIGS. 1 and 2.

As a result of experimentation and cost analysis, it was discovered that plastics were most desirable for fabrication of the rod 3 and tube 2 from the stand point of: price, durability, availability, handling and asthetic value.

While the present invention has been described and illustrated with respect to certain preferred embodiment, it will be obvious to those skilled in the art, after understanding the purposes of the invention, that various changes and modifications may be made without departing from the spirit and scope of the invention, and it is therefore intended to cover all such changes and modifications in the appended claims.

I claim:

1. A shower curtain adapter for expanding the shower space in a shower enclosure formed by first and second opposite facing vertical walls, a third vertical wall extending between said first and second walls and a shower curtain, said shower curtain being vertically hung from a straight standard curtain rod extending in a substantially horizontal plane between said first and second walls, said adapter comprising an adapter rod having a length greater than the distance between said first and second walls, said adapter rod being of flexible material so that when said adapter rod is mounted between said first and second walls it will flex as a result of the presence exerted between said first and second walls and will bow outwardly away from said third wall to engage said shower curtain, coupling means pivotally connected at one end thereof to said adapter rod and pivotally connected at the other end thereof to said standard curtain rod thereby preventing downward movement of said adapter rod when said adapter rod is pressure mounted between said first and second walls and said coupling means is connected to said standard curtain rod, whereby said adapter rod when mounted between said first and second walls will be positioned in a plane below and substantially parallel to said horizontal plane of said standard curtain rod and when unmounted can be hung by said coupling means in a storage position.

2. The shower curtain adapter according to claim 1 wherein said coupling means comprises a ball chain which can be wrapped about said standard curtain rod and said adapter rod so that said adapter rod will be suspended by said coupling means from said standard curtain rod, and means carried by said ball chain for forming couplings at the ends thereof.

3. The shower curtain adapter according to claim 1 wherein said coupling means comprises a frame member formed by a hollow tube, and a ball-chain carried through said hollow tube, said ball-chain at one end of said tube being wrapped about said adapter rod, and means at the other end of said tube for wrapping said ball-chain about said standard curtain rod, so that said frame member will extend between said standard curtain rod and said adapter rod when said adapter rod is mounted below said standard curtain rod.

4. The shower curtain adapter according to claim 1 wherein said coupling means comprises a frame member formed by a relatively inflexible structural element, and circular members carried at opposite ends thereof for connection to said adapter rod and said standard curtain rod to permit sliding movement along said rods, whereby said frame member will extend between said standard curtain rod and said adapter rod at an angle to a vertical plane when said adapter rod is positioned below said standard curtain rod.

5. The shower curtain adapter according to claim 1 further comprising rubber elements carried at the ends of said adapter rod to provide friction mounting between said adapter rod and said first and second vertical walls.

6. The shower curtain adapter according to claim 1 wherein said adapter rod is tubular.

7. The shower curtain adapter according to claim 1 wherein said adapter rod is from five to ten percent longer than the distance between said first and second walls.

8. The shower curtain adapter according to claim 3 wherein said tubular member has a length of from ⅓ to ½ the distance of the height between said standard curtain rod and the bottom of the shower enclosure.

9. The shower curtain adapter according to claim 7 wherein said ball-chain comprises a plurality of rust and corrosion resistant balls linked together into a chain, said balls having a diameter of approximately ⅛ of an inch, said chain being approximately 2¼ times the length of said tubular member.

10. The shower curtain adapter according to claim 9 wherein said tubular member is plastic.

11. The shower curtain adapter according to claim 1 wherein said adapter rod is plastic.

12. The shower curtain adapter according to claim 1 further comprising a stopper carried by said adapter rod so that when said adapter rod is unmounted from its pressure mounted position between said first and second walls it will be in a storage hanging position being supported by said coupling means.

* * * * *